US012631182B2

(12) United States Patent
Geng et al.

(10) Patent No.: US 12,631,182 B2
(45) Date of Patent: May 19, 2026

(54) SCROLL COMPRESSION MECHANISM AND SCROLL COMPRESSOR

(71) Applicant: Copeland Climate Technologies (Suzhou) Co. Ltd., Jiangsu (CN)

(72) Inventors: Liwei Geng, Suzhou (CN); Zhouzhou Lu, Suzhou (CN); Min Su, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 309 days.

(21) Appl. No.: 18/012,247

(22) PCT Filed: Oct. 23, 2020

(86) PCT No.: PCT/CN2020/123044
§ 371 (c)(1),
(2) Date: Dec. 22, 2022

(87) PCT Pub. No.: WO2021/258585
PCT Pub. Date: Dec. 30, 2021

(65) Prior Publication Data

US 2023/0258186 A1 Aug. 17, 2023

(30) Foreign Application Priority Data

Jun. 23, 2020 (CN) ..... 202010579961.8
Jun. 23, 2020 (CN) ..... 202021179695.1

(51) Int. Cl.
*F04C 29/02* (2006.01)
*F04C 18/02* (2006.01)
*F04C 23/02* (2006.01)

(52) U.S. Cl.
CPC ..... *F04C 29/028* (2013.01); *F04C 18/0215* (2013.01); *F04C 23/02* (2013.01)

(58) Field of Classification Search
CPC .. F04C 18/02; F04C 18/0207; F04C 18/0215; F04C 23/02; F04C 29/02; F04C 29/028
(Continued)

(56) References Cited

U.S. PATENT DOCUMENTS 6,478,550 B2 * 11/2002 Matsuba ..... F04C 28/16 417/301
9,915,265 B2 3/2018 Peters
(Continued)

FOREIGN PATENT DOCUMENTS

CN 1637299 A 7/2005
CN 103807166 A * 5/2014
(Continued)

OTHER PUBLICATIONS

Translation of Fujio (Year: 1987).*
(Continued)

*Primary Examiner* — Philip E Stimpert
(74) *Attorney, Agent, or Firm* — Harness, Dickey & Pierce, P.L.C.

(57) ABSTRACT

Disclosed are a scroll compression mechanism and a scroll compressor. The scroll compression mechanism comprises a non-orbiting scroll member, an orbiting scroll member, an oil supply passage, an adjusting valve and a fluid pressure passage comprising a first end and a second end. The first end is in fluid communication with a first pressure source to apply a first pressure to the movable valve body, the second end is in fluid communication with a second pressure source to apply a second pressure to the movable valve body, so that based on a pressure difference between the first and second pressures the movable valve body can selectively move toward a first direction of reducing a flow cross-sectional area of the oil supply passage and toward a second direction of increasing the flow cross-sectional area of the oil supply
(Continued)

passage, thereby adjusting an oil supply amount to the scroll compression mechanism.

13 Claims, 4 Drawing Sheets

(58) Field of Classification Search
USPC ..... 417/410.5, 440, 441
See application file for complete search history.

(56) References Cited

U.S. PATENT DOCUMENTS

| | | | |
|---|---|---|---|
| 2002/0098102 | A1 | 7/2002 | Gennami et al. |
| 2016/0186755 | A1 | 6/2016 | Peters |
| 2018/0080448 | A1 | 3/2018 | Ma et al. |
| 2021/0180594 | A1 | 6/2021 | Fujita et al. |

FOREIGN PATENT DOCUMENTS

| | | | | |
|---|---|---|---|---|
| CN | 105464989 | A | | 4/2016 |
| CN | 105736381 | A | | 7/2016 |
| CN | 205744457 | U | | 11/2016 |
| CN | 106194750 | A | | 12/2016 |
| CN | 109340107 | A | | 2/2019 |
| CN | 212643056 | U | | 3/2021 |
| JP | 62178791 | A | * | 8/1987 |
| JP | S62178791 | A | | 8/1987 |
| JP | H03294683 | A | | 12/1991 |
| JP | H0733829 | B2 | * | 4/1995 |
| JP | 2002180981 | A | | 6/2002 |
| JP | 2002257062 | A | | 9/2002 |
| KR | 20110131751 | A | | 12/2011 |
| WO | 2016173319 | A1 | | 11/2016 |
| WO | 2017071641 | A1 | | 5/2017 |
| WO | 2019107306 | A1 | | 6/2019 |

OTHER PUBLICATIONS

Zhao translation (Year: 2014).*
Chinese Office Action (in English and Chinese) regarding Application No. 202010579961.8, dated May 17, 2024.
Chao Li et al, "Study on Lubricating System for Low-pressure Scroll Compressor", China Academic Journal Electronic Publishing House, Chemical Machinery, Issue 05, 2013, Oct. 15, 2023 (with machine translated English abstract).
International Search Report (English and Chinese) and Written Opinion of the International Searching Authority (Chinese) issued in PCT/CN2020/123044, mailed Jan. 28, 2021; ISA/CN.

* cited by examiner

SCROLL COMPRESSION MECHANISM AND SCROLL COMPRESSOR

This application is the national phase of International Application No. PCT/CN2020/123044 titled "SCROLL COMPRESSION MECHANISM AND SCROLL COMPRESSOR" and filed on Oct. 23, 2020, which claims the benefit of priorities to the following Chinese patent applications: Chinese Patent Application No. 202010579961.8 titled "SCROLL COMPRESSION MECHANISM AND SCROLL COMPRESSOR", filed with the China National Intellectual Property Administration on Jun. 23, 2020; and Chinese Patent Application No. 202021179695.1, titled "SCROLL COMPRESSION MECHANISM AND SCROLL COMPRESSOR", filed with the China National Intellectual Property Administration on Jun. 23, 2020. The entire content of these applications is incorporated herein by reference.

FIELD

The present disclosure relates to a scroll compressor, and in particular to a scroll compressor with improvement in the dynamic adjustment of the oil quantity of a scroll compression mechanism.

BACKGROUND

Compressors (such as scroll compressors) are used in refrigeration (freezing or refrigerating) systems, air conditioning systems and heat pump systems. A scroll compressor includes a compression mechanism for compressing working fluid (such as refrigerant), the compression mechanism further includes an orbiting scroll member and a non-orbiting scroll member. During the operation of the scroll compressor, there is relative motion between the orbiting scroll member and the non-orbiting scroll member of the compression mechanism. In order to reduce wear and power consumption, it is necessary to provide lubrication (such as lubricating oil) to the compression mechanism to improve the friction between the orbiting scroll member and the non-orbiting scroll member, and the produced oil film also improves the sealing performance of the compression mechanism, thus improving the volumetric efficiency.

Generally, an oil circulation rate is used to manifest the amount of lubricating oil carried by the working fluid, and accordingly, the oil circulation rate is used to indicate the level of lubricating oil supplied to the compression mechanism. Too much or too little supply of lubricating oil may adversely affect the normal operation of the compression mechanism itself and the performance and energy efficiency of the system. An excessive oil circulation rate may reduce the heat exchange efficiency of the system, and also make lubricating oil accumulates around (especially above) the discharge valve assembly (such as HVE valve assembly) at the discharge port and the discharge recess of the non-orbiting scroll member, which brings some problems to the scroll compressor (such as the operation stability of the discharge valve assembly and/or the exhaust reliability of the compression mechanism).

In the prior art, an oil supply configuration of a compression mechanism is provided, which can make the oil circulation rate in an appropriate range under different compressor speeds and/or different system operating parameters. However, the oil supply configuration in the prior art cannot adjust the oil injection quantity or oil circulation rate according to the variation of working conditions to meet the requirements of compressor performance, energy efficiency or stability and reliability under different working conditions, for example, under rated load or light load conditions, excessive oil injection leads to excessive oil circulation rate, which reduces the heat exchange efficiency of the system and affects exhaust stability and reliability problem due to lubricating oil accumulation; while under severe working conditions such as high load (e.g., high speed) or high temperature, too little oil injection leads to insufficient lubrication of the compression mechanism, which increases wear and increases power consumption, thus reducing the stability and reliability of compressor.

Therefore, there is a demand for compressor oil supply configuration that can dynamically adjust the oil injection quantity according to the operating conditions.

It should be noted herein that the technical content provided in this section is intended to help those skilled in the art to understand the present disclosure, and may not necessarily constitute the conventional technology.

SUMMARY

A general summary of the present disclosure is provided in this section, rather than the full scope of the present disclosure or a comprehensive disclosure of all features of the present disclosure.

An object according to the present disclosure is to provide a scroll compression mechanism capable of dynamically adjusting oil injection quantity according to working conditions.

To achieve the above object, a scroll compression mechanism is provided according to the present disclosure, including: a non-orbiting scroll member and an orbiting scroll member including an orbiting scroll end plate, the orbiting scroll member and the non-orbiting scroll member cooperate with each other to define a series of working fluid chambers including a central compression chamber and a fluid suction chamber; and an oil supply passage for supplying lubricating oil from a lubricating oil source into the scroll compression mechanism, the scroll compression mechanism further includes: an adjusting valve, which includes a movable valve body; and a fluid pressure passage, which includes a first end and a second end, where the first end is in fluid communication with a first pressure source to apply a first pressure to a first side end of the movable valve body, the second end is in fluid communication with a second pressure source to apply a second pressure to a second side end of the movable valve body, so that based on a pressure difference between the first pressure and the second pressure the movable valve body can selectively move toward a first direction of reducing a flow cross-sectional area of the oil supply passage, and toward a second direction, which is opposite to the first direction, of increasing the flow cross-sectional area of the oil supply passage, thereby adjusting an oil supply amount to the scroll compression mechanism.

Advantageously, the oil supply passage, the adjusting valve and the fluid pressure passage are provided in the orbiting scroll end plate.

Advantageously, the oil supply passage includes a vertical oil supply orifice substantially parallel to a central axis of the scroll compression mechanism, the vertical oil supply orifice leads to the fluid suction chamber, and the movable valve body is partially disposed in the vertical oil supply orifice, so as to adjust the flow cross-sectional area of the oil supply passage by adjusting a flow cross-sectional area of the vertical oil supply orifice.

Advantageously, the oil supply passage further includes a transverse oil supply orifice which is substantially perpendicular to the central axis, the transverse oil supply orifice is intersected and communicated with the vertical oil supply orifice.

Advantageously, the fluid pressure passage includes a transverse fluid pressure orifice which is substantially perpendicular the central axis, and the transverse fluid pressure orifice and the transverse oil supply orifice are horizontally or vertically arranged in the orbiting scroll end plate.

Advantageously, the transverse fluid pressure orifice and the vertical oil supply orifice partially overlap in the vertical direction parallel to the central axis, under the case where the transverse fluid pressure orifice and the transverse oil supply orifice are horizontally arranged, the transverse oil supply orifice includes a main transverse oil supply orifice arranged side by side with the transverse fluid pressure orifice, the transverse oil supply orifice further includes an auxiliary transverse oil supply orifice which is intersected and communicated with both the main transverse oil supply orifice and the vertical oil supply orifice, under the case where the transverse fluid pressure orifice and the transverse oil supply orifice are vertically arranged, the transverse oil supply orifice is arranged side by side with the transverse fluid pressure orifice.

Advantageously, the orbiting scroll member includes a hub part, a base area in an inner space of the hub part near the orbiting scroll end plate serves as the lubricating oil source, an oil inlet end of the oil supply passage is connected to the base area.

Advantageously, the first pressure varies with the variation of the working condition of the scroll compression mechanism, or varies with the variation of the working condition of a system to which the scroll compression mechanism is applied, and/or, the second pressure varies with the variation of the working condition of the scroll compression mechanism, or varies with variation of the working condition of the system to which the scroll compression mechanism is applied.

Advantageously, the adjusting valve further includes an elastic member arranged to abut against the second side end, the elastic member is suitable for biasing the movable valve body toward the first direction.

Advantageously, the first pressure source is the central compression chamber; and/or, the second pressure source is the fluid suction chamber or a low pressure area outside the scroll compression mechanism.

Advantageously, the movable valve body includes a connecting section connecting the first side end and the second side end, a diameter of the connecting section is smaller than a diameter of the first side end and smaller than a diameter of the second side end, and the adjusting valve is arranged such that: when the movable valve body moves toward the first direction, the connecting section occupies less in the oil supply passage to reduce the flow cross-sectional area of the oil supply passage, and when the movable valve body moves toward the second direction, the connecting section occupies more in the oil supply passage to increase the flow cross-sectional area of the oil supply passage.

A scroll compressor is further provided according to the present disclosure, including the above scroll compression mechanism.

Therefore, compared with the compressor without the oil supply configuration, in the scroll compression mechanism including the oil supply configuration of the present disclosure, on the premise of not changing the oil circulation rate under rated working conditions, a relatively high oil circulation rate can be achieved by adjusting the oil injection amount of the compressor under the severe working conditions according to for example the pressure difference, which improves the reliability of the compressor, compared with the traditional oil injection device without adjusting valve, the oil injection quantity or oil circulation rate can be reduced under rated or light load conditions, which is beneficial to improve the energy efficiency (e.g. heat exchange efficiency) of the system to which the compressor is applied, and avoids the problems of discharge stability and reliability caused by the accumulation of lubricating oil at the exhaust port of the compressor mechanism, under the severe working conditions of high temperature and high load, it is possible to obtain an appropriate large oil injection quantity or oil circulation rate, and ensure sufficient lubrication of the compression mechanism, so as to improve the reliability of compressor operation. That is, since the oil supply configuration according to the present disclosure is provided with the adjusting valve that adjusts based on the pressure difference, and the pressure difference dynamically varies with the variation of working conditions, thereby the oil supply amount can be dynamically adjusted to dynamically change the oil circulation rate so as to be matched with the ideal oil circulation rate under various working conditions.

BRIEF DESCRIPTION OF THE DRAWINGS

The features and advantages of one or more embodiments of the present disclosure will become more readily understood from the following description with reference to the accompanying drawings. In the drawings.

DETAILED DESCRIPTION OF THE EMBODIMENTS

The present disclosure is described in detail with reference to the following drawings and by means of exemplary embodiments. The following detailed description of the present disclosure is for purposes of illustration only and is in no way limiting of the present disclosure, its application or uses.

Figure 1:
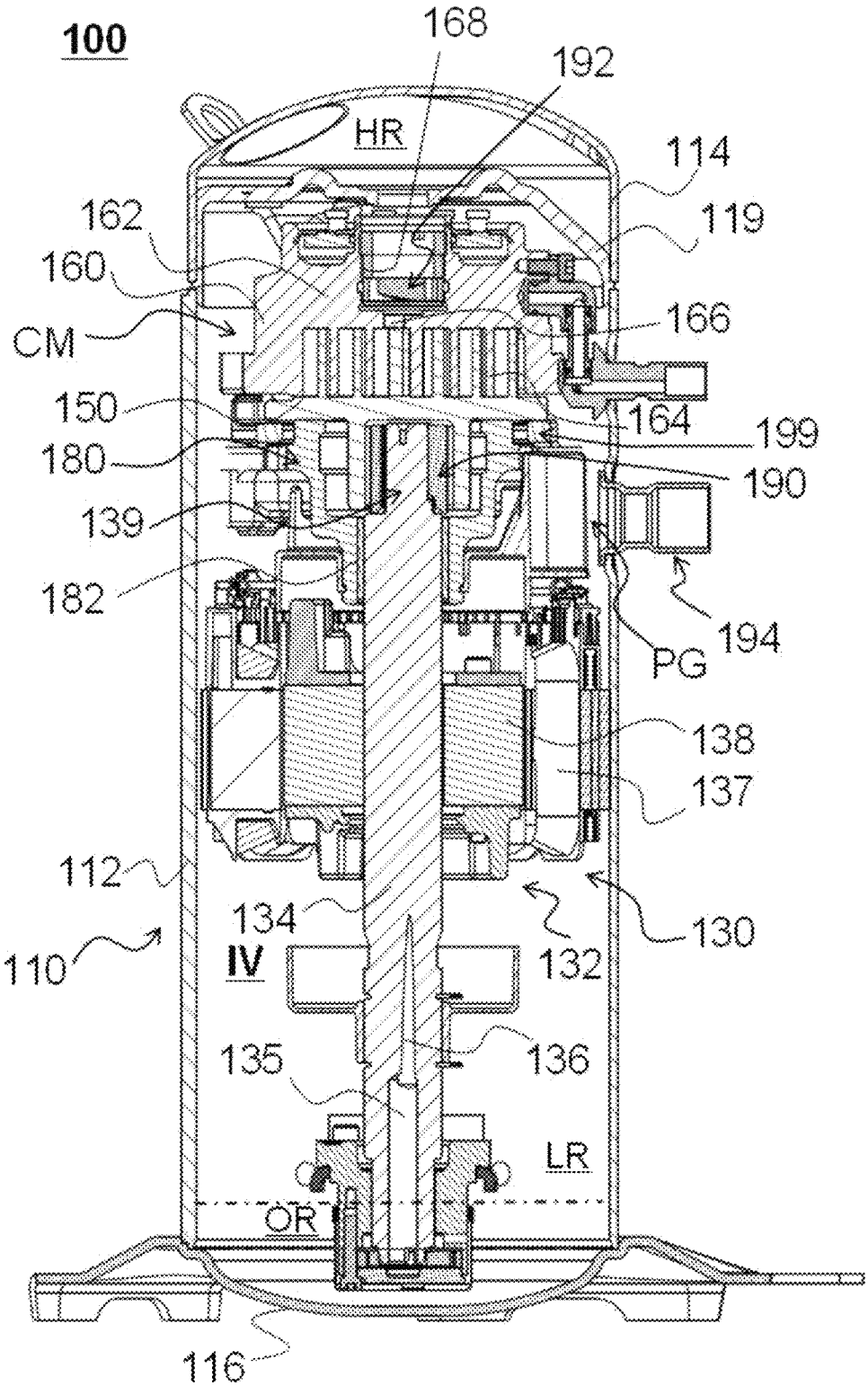
FIG. 1 is a longitudinal sectional view showing a scroll compressor having a compression mechanism with an oil supply configuration of a comparative example.
Figure 2:
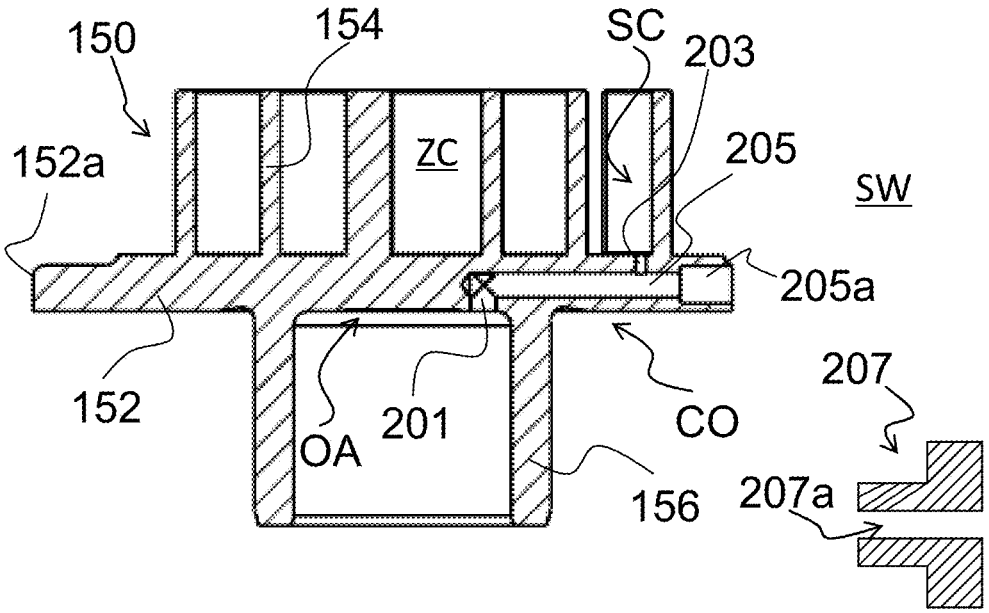
FIG. 2 is a longitudinal cross-sectional view showing an orbiting scroll member of the compression mechanism with the oil supply configuration of the comparative example.

First, referring to FIG. 1 and FIG. 2, FIG. 1 outlines a longitudinal sectional view of a scroll compressor having a compression mechanism with oil supply configuration CO of a comparative example. FIG. 2 is a longitudinal cross-sectional view showing an orbiting scroll member having the compression mechanism with the oil supply configuration of the comparative example.

As shown in FIG. 1, the scroll compressor 100 includes a housing 110. The housing 110 includes a generally cylindrical housing body 112, a top cover 114 mounted to the top of the housing body 112, and a bottom cover 116 mounted to the bottom of the housing body 112. The housing 110 defines an internal volume IV of the scroll compressor 100.

In addition, a partition plate 119 is further provided in the housing 110, so that the partition 119 and the top cover 114 define a high-pressure area, (that is, the discharge pressure area HR, which is suitable for temporarily storing the high-pressure working fluid to be discharged to the outside of the compressor), and the partition plate 119 defines a low-pressure area LR with the housing body 112 and the bottom cover 116. In addition, the lubricant of lubricating oil is stored in the oil reservoir OR at the bottom of the internal volume IV in the housing 110. In the illustrated example, the scroll compressor is a so-called low-pressure side scroll compressor.

The scroll compressor 100 further includes a suction fitting 194. In the illustrated example, the scroll compressor 100 adopts a middle intake design, that is, the suction fitting 194 is arranged at a position approximately aligned with the main bearing seat 180 in the axial direction of the compressor. Therefore, the low-temperature and low-pressure working fluid evaporated by the evaporator is sucked into the scroll compressor 100 through the suction fitting 194 for compression.

The scroll compressor 100 further includes a driving mechanism 130. The driving mechanism 130 includes an electric motor 132 and a driving shaft 134. The electric motor 132 includes a stator 137 and a rotor 138. The stator 137 is fixedly connected to the inner peripheral wall surface of the housing body 112, and the rotor 138 is fixedly sleeved on the driving shaft 134 to rotate integrally with the driving shaft 134. An eccentric pin 139 is provided at the top end of the driving shaft 134.

The scroll compressor 100 further includes a main bearing seat 180. The main bearing seat 180 is fixedly connected to the inner peripheral wall surface of the housing body 112. The main bearing seat 180 is fixedly connected to the inner circumferential wall surface of the housing body 112 by means of multiple radial protrusions thereof which are circumferentially spaced apart, so that multiple main bearing seat passages PG are formed between the main bearing seat 180 and the inner circumferential wall surface of the housing body 112 (that is, between adjacent radial protrusions of the main bearing seat 180) to allow the passage of low-pressure working fluid sucked into the internal volume IV. The main bearing seat 180 supports a part of the driving shaft 134 via a main bearing 182 provided in the main bearing seat 180.

The scroll compressor 100 further includes a compression mechanism CM for compressing working fluid (such as refrigerant). The compression mechanism CM includes an orbiting scroll member 150 and a non-orbiting scroll member 160.

The orbiting scroll member 150 includes: an end plate 152; a spiral orbiting scroll 154 extending upward from a radial central part of the upper surface of the end plate 152; and a hub part 156 extending downward from a radial center of the lower surface of the end plate 152. The orbiting scroll member 150 is arranged at the main bearing seat 180, and is axially supported by the main bearing seat 180 to be capable of orbiting. The eccentric pin 139 is drivingly coupled (inserted) to the hub part 156 (via the unloading bushing 190 and/or the driving bearing).

The non-orbiting scroll member 160 includes: an end plate 162; a spiral non-orbiting scroll 164 extending downward from the lower surface of the end plate 162; a discharge port 166 formed at the approximate center of the end plate 162 and suitable for communicating with the central compression chamber ZC of the compression mechanism CM; and a recess 168 formed at the approximate center of the end plate 162, the recess 168 is located above the discharge port 166 and is suitable for communicating with the discharge port 166 and with the discharge pressure area HR. An exhaust valve assembly (such as HVE valve assembly) 192 is provided in the recess 168 to control the exhaust of the compression mechanism CM. In the example shown in the figure, the non-orbiting scroll 164 includes a radially outermost (annular) outer wall, and a compression mechanism suction window SW is provided at an appropriate circumferential position in the outer wall, the suction window SW allows the low-pressure working fluid to be sucked into the compression mechanism CM, the suction window SW defines a suction pressure area SP.

The non-orbiting scroll 164 is suitable for being engaged with the orbiting scroll 154, thereby defining a series of crescent-shaped working fluid accommodating chambers. These accommodating chambers include: an unsealed fluid suction chamber SC with a low pressure in which gas is being taken in; a closed compression accommodating chamber with increased pressure which is in the process of compressing; and a central compression chamber ZC which has completed compression and is exhausting through the exhaust port 166 and the exhaust valve assembly 192. The fluid suction chamber SC is suitable for communicating with the suction window SW so as to be able to receive the low-pressure working fluid sucked from the suction window SW.

The scroll compressor 100 further includes a lubrication system mainly used to provide lubrication to the relatively moving parts of the compressor, such as the compression mechanism CM, the main bearing 182, the eccentric pin 139, the unloading bushing 190 and the driving bearing. The lubrication system includes: oil reservoir OR (main lubricant source) as mentioned above; an oil supply passage provided in the driving shaft 134 and including a central hole 135 at the lower part of the driving shaft and an eccentric hole 136 at the upper part of the driving shaft; a lubricating eccentric pin 139, a lubricant storage area (auxiliary lubricant source) for temporarily storing lubricant that stays in main bearing seat 180 after lubricating eccentric pin 139, unloading bushing 190, driving bearing and/or main bearing 182; a compression mechanism oil supply configuration CO that supplies lubricant from the lubricant storage area to the compression mechanism CM (see FIG. 2); and an oil return passage for returning lubricant from the lubricant storage area to the oil reservoir OR.

In particular, the lubricant storage area includes a lubricant storage area (the base area of the orbiting scroll end plate) OA located between the top end face of the eccentric pin 139, the unloading bushing 190 and/or the driving bearing and the lower surface of the orbiting scroll end plate 152 and located in the hub part 156 (see FIG. 2).

When the scroll compressor 100 operates, the electric motor 132 is energized to rotate the rotor 138 integrally with the driving shaft 134. The eccentric pin 139 integrally formed with the driving shaft 134 also rotates, thereby driving the hub part 156 via the unloading bushing 190 and/or the driving bearing, and thus the orbiting scroll member 150 is made to translate, that is, orbit, relative to the non-orbiting scroll member 160 by means of a cross slip ring 199. (That is, the axis of the orbiting scroll member 150 revolves relative to the axis of the non-orbiting scroll member 160, but both the orbiting scroll member 150 and the non-orbiting scroll member 160 themselves do not rotate around their respective axis). Meanwhile, the low-pressure working fluid sucked from the suction fitting 194 passes through the main bearing seat 180 along the main bearing seat passage PG, then enters the compression mechanism CM through the suction window SW (specifically flows into the fluid suction chamber SC).

Therefore, in the process of moving from the radially outer side to the radially inner side, the accommodating chambers defined by the non-orbiting scroll 164 and the orbiting scroll 154 change from the unsealed fluid suction chamber SC to the compression accommodating chamber and then to the central compression chamber ZC (with exhaust pressure), and the volume of the accommodating chamber gradually decreases. In this way, the pressure in the accommodating chamber is gradually increased, the working fluid is compressed and finally discharged from the discharge port 166 to the discharge pressure area HR, and then discharged outside of the compressor via a discharge fitting (not shown).

Meanwhile, under the centrifugal force generated by the rotation of the driving shaft 134, the lubricant can be delivered from the oil reservoir OR to the lubricant storage area (such as the lubricant storage area OA) via the oil supply passage (specifically, the central hole 135 and the eccentric hole 136). Then, a part of the lubricant temporarily stored in the lubricant storage area OA is supplied to the compression mechanism CM (such as to an appropriate area of the fluid suction chamber SC) through the compression mechanism oil supply configuration CO, so as to provide lubrication to the compression mechanism CM. Then, the remaining lubricant temporarily stored in the lubricant storage area OA is returned to the oil reservoir OR through the oil return passage.

The compression mechanism oil supply configuration CO of the lubrication system in the comparison example is described below with reference to FIG. 2. (FIG. 2 is a longitudinal cross-sectional view showing the orbiting scroll member combined with the compression mechanism oil supply configuration of the comparative example).

The compression mechanism oil supply configuration CO includes: an oil inlet end (oil inlet hole) 201 communicating with the lubricant storage area OA; and a transverse hole 205 communicating with the oil inlet end 201. The oil inlet end 201 and the transverse hole 205 are formed in the orbiting scroll end plate 152. The oil inlet end 201 is an axial hole extending in the axial direction. The opening position (the flow opening position) of the horizontal hole 205 on the outer peripheral surface 152*a* is set in the flow path of the sucked low-pressure working fluid. The suction fitting 194 is arranged to be aligned with the main bearing seat passage PG.

In addition, the transverse hole 205 includes a counterbore 205*a* located at the radially outer section, and the inner diameter of the counterbore 205*a* is larger than the inner diameter of the remaining section of the transverse hole 205, the compression mechanism oil supply configuration CO further includes an oil outlet hole 203 communicating with an appropriate area of the fluid suction chamber SC. A plug 207 is adapted to be connected to the counterbore 205*a*, and a through hole 207*a* is provided in the plug 207.

Therefore, according to the compression mechanism oil supply configuration of the comparative example, during the operation of the scroll compressor, when the lubricant from the lubricant storage area OA is discharged from the opening of the transverse hole 205 out of the orbiting scroll end plate 152, the discharged lubricant is made to meet the sucked low-pressure working fluid, so that the low-pressure working fluid can bring a part of the lubricant into the compression mechanism CM. Compared with the solution of not providing an active oil injection mechanism for supplying oil to the compression mechanism, this solution can keep the oil circulation rate in an appropriate range under different compressor speeds and/or different system operating parameters. In addition, the setting of the counterbore is helpful to reduce the speed of lubricant exiting the orbiting scroll end plate and improve the mist spray of lubricant; by arranging an outlet hole additionally, the lubricant is allowed to be directly delivered to the fluid suction chamber SC, that is, to the compression mechanism CM, so as to appropriately improve the oil circulation rate; furthermore, the adjustment freedom of the oil circulation rate is improved by alternatively setting a plug with a through hole.

However, the above-mentioned oil supply configuration CO is limited by the simple structure design, and unable to adjust the oil injection quantity or oil circulation rate according to the variation of working conditions, so it can't meet the requirements of compressor performance, energy efficiency or reliability under different working conditions. Under different working conditions, too little oil injection or too much oil injection may affect the energy efficiency or reliability of the compressor (for example, under rated load or light load conditions and high load (such as high speed) or high temperature and other harsh conditions).

For the above, an inventive concept is provided according to the present disclosure: different working conditions correspond to different compressor loads (described by parameters such as suction pressure and discharge pressure, evaporation pressure and condensation pressure, suction temperature and discharge temperature), and the pressure difference between the discharge pressure and the suction pressure can be used to adjust the oil injection quantity under different compressor loads (That is, building a dynamic relationship between the operating conditions and the oil injection quantity, for example, increase the oil injection quantity at high load and high pressure difference, and reduce the oil injection quantity at rated load or low load and low pressure difference) to improve the energy efficiency or reliability of the compressor system.

Figure 3:
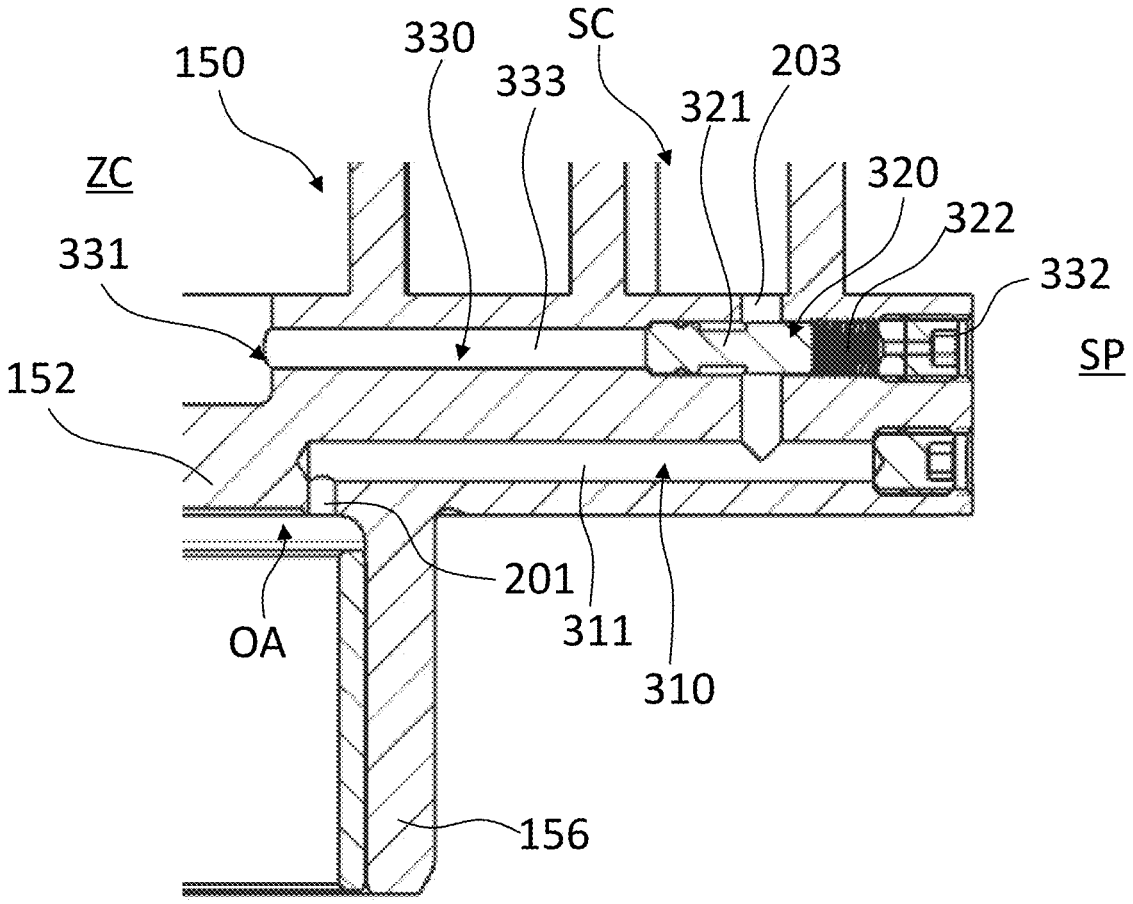
FIG. 3 is a longitudinal sectional view showing an embodiment of a scroll compression mechanism according to the present disclosure.
Figure 4:
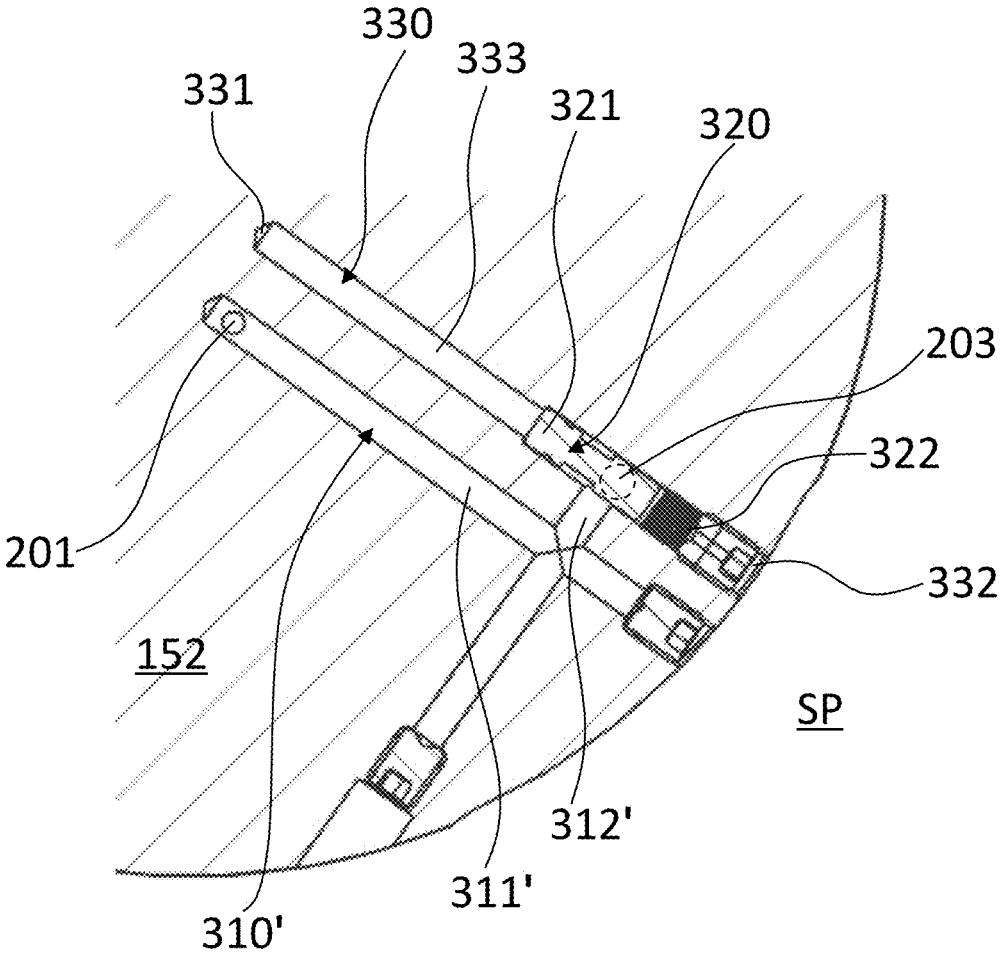
FIG. 4 is a transverse sectional view showing another embodiment of the scroll compression mechanism according to the present disclosure.

The scroll compression mechanism with oil supply configuration of the present disclosure is mainly described below with reference to FIG. 1 and FIG. 2 as well as FIG. 3 and FIG. 4, compared with the compressor in the comparison example, basically other components except for the oil supply configuration are basically the same or similar, the reference numbers of the same components in the scroll compressor combined with the oil supply configuration of the comparative example continue to be used.

The oil supply configuration of the scroll compression mechanism of the present disclosure includes an oil supply passage, an adjusting valve 320 and a fluid pressure passage 330 provided in the orbiting scroll end plate 152, the oil supply passage is used to supply lubricating oil from the lubricating oil source into the scroll compression mechanism CM. The adjusting valve 320 includes a movable valve body 321, and the fluid pressure passage 330 includes a first end 331 and a second end 332, The first end 331 is in fluid communication with the central compression chamber ZC on the high pressure side to apply a higher first/discharge pressure to the first/high pressure side end of the movable valve body 321, where the central compression chamber ZC fluidly communicates with the discharge pressure area HR, the second end 332 communicates with the suction pressure area/low pressure area SP located outside the scroll compression mechanism CM to apply a low second/suction pressure to the second/low pressure side end of the movable valve body 321, so that based on the pressure difference between the first/discharge pressure and the second/suction pressure the movable valve body 321 can selectively move toward a first direction of reducing the flow cross-sectional area of the oil supply passage, and toward a second direction opposite to the first direction of increasing the flow cross-sectional area of the oil supply passage, thereby adjusting the oil supply quantity to the compression mechanism CM according to the pressure difference corresponding to the variation of working conditions.

With the aid of the oil supply configuration, the oil injection quantity or oil circulation rate can be dynamically adjusted according to the variation of working conditions such that, for example, under high load conditions (high suction and discharge temperatures, high condensation and evaporation temperature), the oil injection quantity is correspondingly increased with the pressure difference between the discharge pressure and the suction pressure becoming larger, so that the increased oil circulation rate ensures the sufficient lubrication requirement of lubricant and ensures the stability and reliability of compressor system operation, while under rated load or light load, the oil injection quantity is reduced accordingly to improve the energy efficiency of the compressor system.

In the experimental test, for example, under the case where other working states or performance parameters of the compressor are the same, at different evaporation temperatures/condensation temperatures: 45/95, 45/120, 55/150, 40/150 respectively, the compression mechanism with the oil supply configuration in the prior art provides a basically constant oil circulation rate of 1.5%, so that an excessively high oil circulation rate is provided at a low evaporation temperature/condensation temperature and an excessively low oil circulation rate is provided at a high evaporation temperature/condensation temperature, thus exceeding the reasonable range of oil circulation rate. In contrast, the compression mechanism with the oil supply configuration according to the present disclosure provides the oil circulation rate that adapts to variations: 0.5%, 0.5%, 1.5% and 1.4% respectively, so that the oil circulation rate under each working condition can be within the reasonable range of the oil circulation rate under the corresponding working condition.

It can be understood by those skilled in the art that although the lower pressure source is shown as the low pressure area SP located outside the scroll compression mechanism CM, the lower pressure source may also be a fluid suction chamber SC with lower pressure that is not closed and is sucking gas.

In FIG. 3 and FIG. 4, similarly to the comparative example, the orbiting scroll end plate 152 is provided with an oil outlet hole 203 communicating with an appropriate area of the fluid suction chamber SC, the oil outlet hole 203 can be in the form of a vertical hole or an inclined hole and as a part of the oil supply orifice. In the embodiment of the present application, the oil outlet hole 203 is a vertical oil supply orifice substantially parallel to the central axis of the scroll compression mechanism. The movable valve body 321 is partially disposed in the vertical oil supply orifice 203, thereby adjusting the flow cross-sectional area of the oil supply passage by adjusting the flow cross-sectional area of the vertical oil supply orifice 203. The oil supply passages 310, 310' further include a transverse oil supply orifice approximately perpendicular to the central axis of the scroll compression mechanism CM, the transverse oil supply orifice is intersected and communicated with the vertical oil supply orifice 203 to supply lubricating oil from the lubricating oil source to the scroll compression mechanism CM.

As shown in FIG. 3 and FIG. 4, the fluid pressure passage 330 may include a transverse fluid pressure orifice 333 substantially perpendicular to the central axis of the scroll compression mechanism CM. According to the actual requirements such as the shape and configuration of the orbiting scroll end plate 152, the transverse fluid pressure orifice 333 can be horizontally or vertically arranged with the transverse oil supply orifice in the orbiting scroll end plate 152, for example, when the orbiting scroll end plate is thick, the transverse fluid pressure orifice 333 and the transverse oil supply orifice 311 of the oil supply passage 310 may be vertically arranged, as shown in FIG. 3.

In an advantageous aspect of the embodiment, the transverse fluid pressure orifice 333 partially overlaps with the vertical oil supply orifice 203 in the vertical direction parallel to the central axis, so as to realize effective oil supply orifice arrangement and avoid processing additional communication orifices. In FIG. 4, the transverse fluid pressure orifice 333 is horizontally arranged with the transverse oil supply orifice of the oil supply passage 310', the transverse oil supply orifice includes a main transverse oil supply orifice 311' which is arranged side by side with the transverse fluid pressure orifice 333 and communicates with the lubricant source (through the oil inlet end 201). In addition, the transverse oil supply orifice further includes an auxiliary transverse oil supply orifice 312' which is intersected and communicated with both the main transverse oil supply orifice 311' and the vertical oil supply orifice 203. That is, the main transverse oil supply orifice 311' is intersected and communicated with the vertical oil supply orifice 203 through the auxiliary transverse oil supply orifice 312'. It can be understood that the transverse oil supply orifice may only include the main transverse oil supply orifice 311', the main transverse oil supply orifice 311' may be an oblique oil supply orifice relative to the transverse fluid pressure orifice 333 and directly intersected and communicated with the vertical oil supply orifice 203. In FIG. 3, the transverse fluid pressure orifice 333 and the transverse oil supply orifice 311 are arranged vertically and side by side, the transverse oil supply orifice 311 (through the oil inlet end 201) is communicated with the lubricant source and is intersected and communicated with the vertical oil supply orifice 203. In fact, the arrangement makes the transverse oil supply orifice 311, the vertical oil supply orifice 203 and the transverse fluid pressure orifice 333 substantially be located in the same vertical plane, so that a more reasonable oil supply orifice arrangement can be realized.

The adjusting valve 320 further includes an elastic member 322 provided to be able to abut against the second/low pressure side end of the movable valve body 321. The elastic member 322 is shown as a spring, one end of the spring is connected to a plug arranged in a counterbore at the radially outer section of the transverse fluid pressure orifice 333, the other end of the spring is connected to the second/low pressure side end of the movable valve body 321, and is suitable for biasing the movable valve body 321 toward the first/high pressure side.

The movable valve body 321 includes a connecting section connecting the first/high pressure side end and the second/low pressure side end, the connecting section is tapered relative to the first/high pressure side end and the second/low pressure side end, the connecting section in the figure is shown as a stepped surface, and may also be a curved surface or a conical surface. The diameter of the tapered connecting section is smaller than the diameter of the first/high pressure side end and smaller than the diameter of the second/low pressure side end. In different working conditions of the compressor, such as rated load or light load, the pressure difference between the first/discharge pressure and the second/suction pressure is smaller than the biasing force of the elastic member, so that the movable valve body 321 moves toward the first/high pressure side, the tapered connecting section occupies less (the low pressure side end with larger diameter occupies more) in the oil supply passage, such as the vertical oil supply orifice 203, thereby reducing the flow cross-sectional area of the oil supply passage and reducing the oil injection quantity; while at high load, the pressure difference between the first/discharge pressure and the second/suction pressure is greater than the biasing force of the elastic member, so that the movable valve body 321 moves toward the second/low pressure side, the tapered connecting section occupies more (the low pressure side end with larger diameter occupies less) in the vertical oil supply orifice 203, thereby increasing the cross-sectional area of the oil supply passage, thus increasing the injection quantity.

The figure shows that the base area OA in the inner space of the hub part 156 of the orbiting scroll member 150 close to the orbiting scroll end plate 152 is used as a lubricating oil source, the oil inlet end 201 of the oil supply passage is connected to the base area OA. The oil reservoir OR stored at the bottom of the internal volume IV in the housing 110 may also be used as a lubricating oil source.

Those skilled in the art can understand that, the first pressure varies with the working condition of the scroll compression mechanism CM or the working state of the system to which the scroll compression mechanism CM is applied, and/or, the second pressure varies with the working condition of the scroll compression mechanism CM or the working state of the system to which the scroll compression mechanism CM is applied.

In this document, the use of orientation terms such as "horizontal" and "vertical" is only for convenience of description, and should not be regarded as limiting.

Although the present disclosure has been described with reference to exemplary embodiments, it should be understood that the present disclosure is not limited to the specific embodiments described and shown in detail herein, without departing from the scope defined in the claims, those skilled in the art can make various changes to the exemplary embodiments.

The invention claimed is:

1. A scroll compressor, comprising:

a housing comprising a housing body, a top cover and a bottom cover, wherein a partition plate is provided in the housing so that the partition defines a high-pressure area with the top cover and the partition plate defines a low-pressure area with the housing body and the bottom cover; and a compression mechanism provided in the low-pressure area, comprising:

a non-orbiting scroll member and an orbiting scroll member comprising an orbiting scroll end plate, wherein the orbiting scroll member and the non-orbiting scroll member cooperate with each other to define a series of working fluid chambers comprising a central compression chamber and a fluid suction chamber; and an oil supply passage for supplying lubricating oil from a lubricating oil source into the scroll compression mechanism, wherein the scroll compression mechanism further comprises:

an adjusting valve comprising a movable valve body; and a fluid pressure passage comprising a first end and a second end, wherein the first end is in fluid communication with a first pressure source to apply a first pressure to a first side end of the movable valve body, the second end is in fluid communication with a second pressure source to apply a second pressure to a second side end of the movable valve body, so that based on a pressure difference between the first pressure and the second pressure the movable valve body can selectively move toward a first direction of reducing a flow cross-sectional area of the oil supply passage and toward a second direction, which is opposite to the first direction, of increasing the flow cross-sectional area of the oil supply passage, thereby adjusting an oil supply amount to the scroll compression mechanism, wherein the second pressure source is the fluid suction chamber or the low pressure area outside the scroll compression mechanism.

2. The scroll compressor according to claim 1, wherein the oil supply passage, the adjusting valve and the fluid pressure passage are provided in the orbiting scroll end plate.

3. The scroll compressor according to claim 2, wherein:

the oil supply passage comprises a vertical oil supply orifice substantially parallel to a central axis of the scroll compression mechanism, the vertical oil supply orifice leads to the fluid suction chamber, and the movable valve body is partially disposed in the vertical oil supply orifice, so as to adjust the flow cross-sectional area of the oil supply passage by adjusting a flow cross-sectional area of the vertical oil supply orifice.

4. The scroll compressor according to claim 3, wherein:

the oil supply passage further comprises a transverse oil supply orifice which is substantially perpendicular to the central axis, the transverse oil supply orifice is intersected and communicated with the vertical oil supply orifice.

5. The scroll compressor according to claim 4, wherein:

the fluid pressure passage comprises a transverse fluid pressure orifice which is substantially perpendicular the central axis, and the transverse fluid pressure orifice and the transverse oil supply orifice are horizontally arranged in the orbiting scroll end plate.

6. The scroll compressor according to claim 5, wherein:

the transverse fluid pressure orifice and the vertical oil supply orifice partially overlap in the vertical direction parallel to the central axis, and the transverse oil supply orifice comprises a main transverse oil supply orifice arranged side by side with the transverse fluid pressure orifice, the transverse oil supply orifice further comprises an auxiliary transverse oil supply orifice which is intersected and communicated with both the main transverse oil supply orifice and the vertical oil supply orifice.

7. The scroll compressor according to claim 2, wherein the orbiting scroll member comprises a hub part, a base area in an inner space of the hub part near the orbiting scroll end plate serves as the lubricating oil source, an oil inlet end of the oil supply passage is connected to the base area.

8. The scroll compressor according to claim 1, wherein the first pressure varies with the variation of the working condition of the scroll compression mechanism, or varies with variation of the working condition of a system to which the scroll compression mechanism is applied, and/or, the second pressure varies with the variation of the working condition of the scroll compression mechanism, or varies with the variation of the working condition of the system to which the scroll compression mechanism is applied.

9. The scroll compressor according to claim 1, wherein the adjusting valve further comprises an elastic member arranged to abut against the second side end, the elastic member is suitable for biasing the movable valve body toward the first direction.

10. The scroll compressor according to claim 1, wherein:

the first pressure source is the central compression chamber.

11. The scroll compression mechanism compressor according to claim 1, wherein:

the movable valve body comprises a connecting section connecting the first side end and the second side end, a diameter of the connecting section is smaller than a diameter of the first side end and smaller than a diameter of the second side end, and the adjusting valve is arranged such that: when the movable valve body moves toward the first direction, the connecting section occupies less in the oil supply passage to reduce the flow cross-sectional area of the oil supply passage, and when the movable valve body moves toward the second direction, the connecting section occupies more in the oil supply passage to increase the flow cross-sectional area of the oil supply passage.

12. The scroll compressor according to claim 4, wherein:

the fluid pressure passage comprises a transverse fluid pressure orifice which is substantially perpendicular the central axis, and the transverse fluid pressure orifice and the transverse oil supply orifice are vertically arranged in the orbiting scroll end plate.

13. The scroll compressor according to claim 12, wherein:

the transverse fluid pressure orifice and the vertical oil supply orifice partially overlap in the vertical direction parallel to the central axis, and the transverse oil supply orifice is arranged side by side with the transverse fluid pressure orifice.

* * * * *